US006424096B1

(12) United States Patent
Lowe et al.

(10) Patent No.: US 6,424,096 B1
(45) Date of Patent: Jul. 23, 2002

(54) REMOTELY CONTROLLED LIGHT DISPLAYS

(76) Inventors: Donovan S. Lowe, 8341 Wilcox, Anchorage, AK (US) 99502; Steve Ranta, 3637 12th Ave. W., Seattle, WA (US) 98119; Paul Szabo, 7051 21st Ave. NE., Seattle, WA (US) 98115

( * ) Notice: Subject to any disclaimer, the term of this patent is extended or adjusted under 35 U.S.C. 154(b) by 0 days.

(21) Appl. No.: 09/556,003

(22) Filed: Apr. 18, 2000

(51) Int. Cl.[7] ..... H05B 37/02
(52) U.S. Cl. ..... 315/185 R; 315/295; 315/316
(58) Field of Search ..... 315/292, 295, 315/362, 316, 185 R

(56) References Cited

U.S. PATENT DOCUMENTS

| | | | | |
|---|---|---|---|---|
| 4,057,735 A | | 11/1977 | Davis, Jr. | 307/11 |
| 4,264,845 A | | 4/1981 | Bednarz | 315/323 |
| 4,656,398 A | * | 4/1987 | Michael et al. | 315/293 |
| 4,713,586 A | | 12/1987 | Chiang | 315/200 |
| 5,006,724 A | | 4/1991 | Liu | 307/11 |
| 5,128,595 A | | 7/1992 | Hara | 315/312 |
| 5,485,068 A | | 1/1996 | Vaught | 318/568.1 |
| 5,632,550 A | | 5/1997 | Yeh | 362/123 |
| 5,747,940 A | | 5/1998 | Openiano | 315/185 |
| 6,166,496 A | * | 12/2000 | Lys et al. | 315/316 |

FOREIGN PATENT DOCUMENTS

GB 2245699 A 8/1992

* cited by examiner

*Primary Examiner*—David Vu
(74) *Attorney, Agent, or Firm*—Delbert J. Barnard

(57) ABSTRACT

A hand-held transmitter (T) delivers an IR control signal to a receiver (R) that is connected to send the signal to a lighting control module (LCM) within a housing (16). A cable (18) of light strings (20, 22, 24, 26) and a common conductor (28) extends away from the housing (16) a distance sufficient to provide a desired number of lights (30, 32, 34, 36). All lights (30, 32, 34, 36) may be the same color or each light string (20, 22, 24, 26) may have lights of a color different from the color of any other light string. The receiver conductor 39 may be wound on the cable (18). In use, an AC plug (12) is plugged into an AC receptacle. A first length of wiring (14) and the receiver conductor (39) space the receiver (R) a predetermined distance from the AC receptacle. This allows the receiver (R) to be positioned forwardly of a Christmas tree or other object in which the light display (10) is placed. The window (40) of the receiver 38 is oriented so that it is easily reachable by a wireless control signal that is emitted from the transmitter (T).

22 Claims, 6 Drawing Sheets

FIG.3
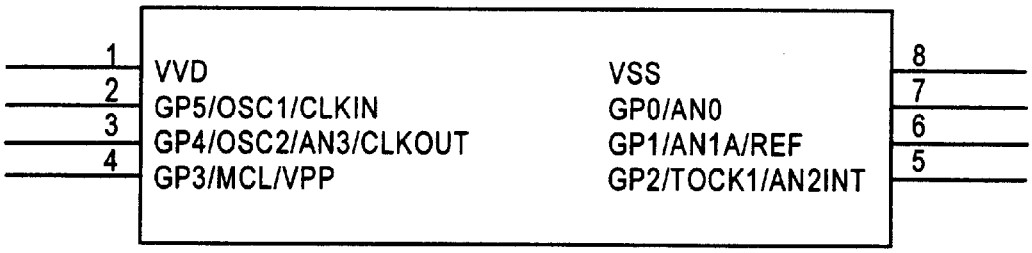
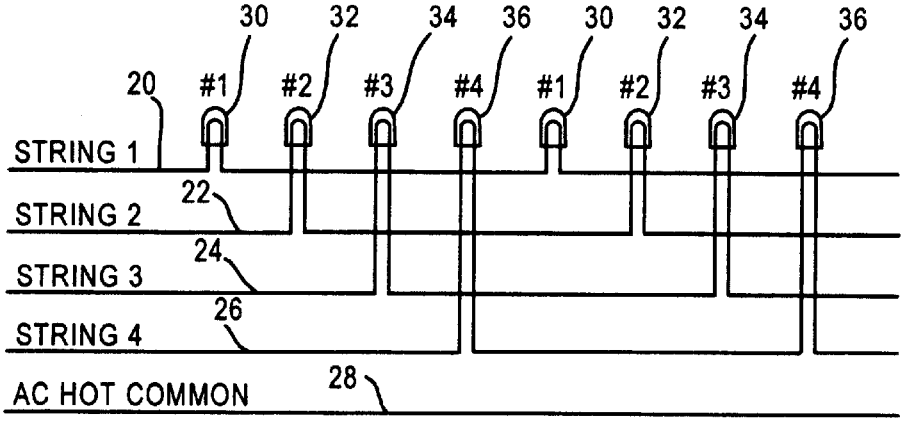
FIG.4
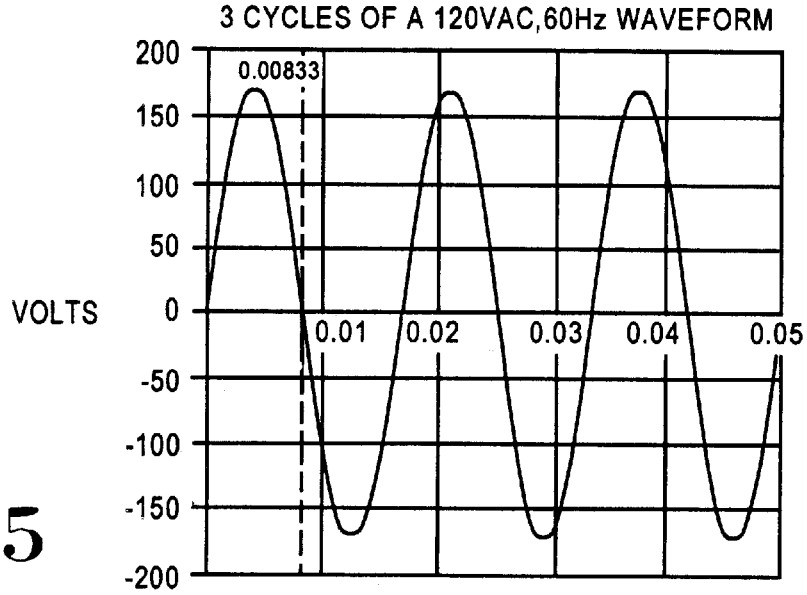
FIG.5

REMOTELY CONTROLLED LIGHT DISPLAYS

TECHNICAL FIELD

This invention relates to light displays of a type comprising a plurality of light strings, each including a plurality of spaced apart lights connected together in series, e.g. Christmas lights. More particularly, it relates to a remote control system for such a light display.

BACKGROUND OF THE INVENTION

Light displays are known that comprise a plurality of light strings, each including a plurality of spaced apart lights connected together in series. It is also known to vary the color makeup of the light strings. For example, all of the lights of the display may be the same color. Or, each light string may consist of lights of a particular color that is different from the color of the lights of each other string. It is further known to vary the brightness of the lights, to cycle the lights on and off, and to fade the lights from a full off to a full on condition in such a manner that the lights appear to be traveling.

Known light displays in the patent literature are disclosed by U.S. Pat. No. 4,057,735, granted Nov. 8, 1977, to George B. Davis, Jr.; by U.S. Pat. No. 4,713,586, granted Dec. 15, 1987, to Chung C. Chiang; by U.S. Pat. No. 4,264,845, granted Apr. 28, 1981, to Robert W. Bednarz; by U.S. Pat. No. 5,006,724, granted Apr. 9, 1991 to Ching-Chung Liu; by U.S. Pat. No. 5,128,595, granted Jul. 7, 1992, to Kanichi Hara; by U.S. Pat. No. 5,485,068, granted Jan. 16, 1996, to Michael Vaught; by U.S. Pat. No. 5,632,550, granted May 27, 1997, to Ren S. Yeh; by U.S. Pat. No. 5,639,157, granted Jun. 17, 1997, to Ren Shan Yeh; by U.S. Pat. No. 5,747,940, granted May 5, 1998, to Renato M. Openiano; and by United Kingdom patent application No. 2,245,699A, filed Jul. 4, 1990, by GEC-Marconi Ltd. and published on Jan. 8, 1992.

U.S. Pat. No. 5,639,157 discloses a multiple string light display having a control unit that is built into the wiring path that extends from an AC plug to the start of the light strings. The control unit is within a housing that includes an exposed push-button control switch. An integrated circuit is positioned within the housing and functions to operate each of the circuit paths by driving semi-conductor drivers that are connected between the respective circuit paths and a ground bus.

There is a need for a multiple string light display that can be remotely controlled by an operator by use of a remote control signal transmitter. It is a principal object of the present invention to provide such a light display.

BRIEF SUMMARY OF THE INVENTION

The light display of the present invention is basically characterized by a plurality of light strings, each including a plurality of spaced apart lights connected together in series. A receiver and a lighting control module (LCM) are associated with the light strings. The receiver is adapted for receiving wireless command signals from a transmitter. The LCM comprises electronic circuitry including a microprocessor programmed to receive and decode specific wireless command signals that are transmitted to the receiver, and in response to said command signals operate the circuitry to cause the lights to illuminate in specific defined patterns dictated by the command signal. A remote control transmitter is provided to provide the command signals. The transmitter is adapted to generate and transmit wireless command signals to the receiver for selectively establishing the specific defined patterns for the light strings.

According to an aspect of the invention, the transmitter is programmable to send, the receiver is adapted to receive and the LCM is programed to use wireless command signals that operate the light strings to provide one, some or all of the following defined patterns: change the degree of brightness of at least some of the lights; cause at least some of the lights to blink; and change the lights from brightness to dark at staggered intervals so as to produce a traveling effect.

In preferred form, at least one light string includes lights that are different in color from at least one other light string. For example, each light string may include lights of one color that are different in color from the lights of each other string.

According to another aspect of the invention, the light display includes an AC plug adapted to fit into an AC receptacle. The lighting control module is spaced from the AC plug and a first length of wiring extends from the AC plug to the LCM. The plurality of light strings extend from the LCM opposite the first length of wiring. The receiver is spaced from the LCM and a second length of wiring extends from the LCM to the receiver. When the AC plug is within an AC receptacle, the first length of wiring will extend from the plug to the LCM. The light strings and the second length of wiring will extend from the LCM.

In preferred form, the second length of wiring extends contiguously along the light strings from the LCM and the receiver is contiguous the light strings. A loop, hook or tie, etc. is provided in the vicinity of the receiver and is positioned such that it can be connected to an object that is to receive the light display. As a result, the receiver will be positioned adjacent such object in a spaced relationship from the AC receptacle. For example, the light strings may be wound onto and around a Christmas tree, starting at lower limbs and extending upwardly on the tree. The AC plug may be plugged into an AC receptacle in a wall near the tree. The first length of wiring is preferably of sufficient length to extend from the AC receptacle to the tree. The second length of wiring is preferably of a length to extend partially around a lower portion of the tree into a position at or near the front of the tree. The loop, hook or tie, etc. may be connected to a lower limb in such a position that the receiver is facing forwardly from the tree. This enables an operator to stand back from the tree and point the discharge end of the transmitter towards the receiver, in much the same way that a remote control transmitter for a television is pointed towards a receiver that is built into the television.

It is a further aspect of the invention to provide the LCM with a programmable microprocessor. It is yet another aspect of the invention to use a hand-held transmitter that is programmable to send wireless command signals that the microprocessor is programmed to receive and use.

It is also within the scope of the invention to build the receiver into a housing that contains the LCM. It is further within the scope of the invention to position the receiver at the AC plug. The receiver may be contained within a housing that includes the AC plug such that when the prongs on the plug are within the openings in the receptacle, the receiver housing is mounted on the face of the receptacle. Or, the LCM, the receiver and the AC plug may be combined into a single housing that becomes mounted onto the face of the receptacle when the plug prongs are within the receptacle openings.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

In the drawings, like reference numerals and letters designate like parts throughout the several views and:

FIG. 3 is an enlarged view of the microprocessor shown in FIG. 2;

FIG. 4 is a schematic diagram of the light strings, showing only two of the lights of each string;

FIG. 5 is a waveform diagram of the wave form that causes the light strings to appear at full brightness;

DETAILED DESCRIPTION OF THE INVENTION

Figure 1:
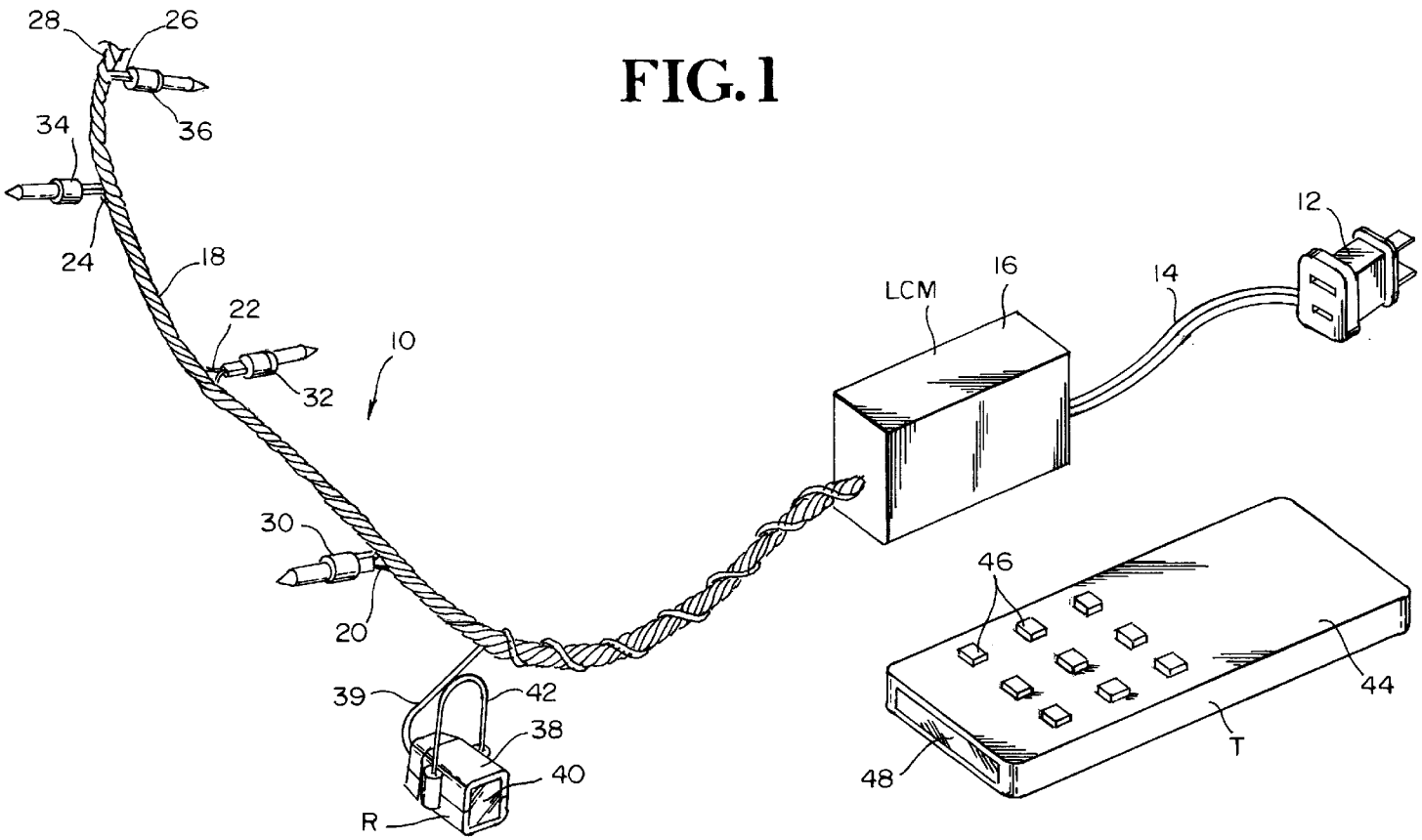
FIG. 1 is a fragmentary pictorial view of a plug end portion of an embodiment of the light display of the present invention, showing a transmitter, a receiver, a lighting control module and an AC plug.

FIG. 1 shows a plug end portion of a light display 10 which may constitute lights for a Christmas tree. The display 10 includes an AC plug 12 adapted to be plugged into the openings in an AC receptacle. A first length of wiring 14 extends from the AC plug 12 to a lighting control module (LCM) that is in a housing 16. A light string cable 18 extends from the housing 16 in a direction opposite from the wiring 14. The number of light strings can vary. However, four is a typical number of light strings. In a typical system, the cable 18 comprising four light string conductors and a fifth common conductor for a total of five conductors. Per conventional practice, the five conductors 20, 22, 24, 26, 28 are wound together to form the cable 18. Also, the number of lights per string may vary. For example, each light string may include thirty-five lights, for a total of one hundred forty lights. Or, each light string may include thirty lights, for a total of one hundred and twenty lights. FIG. 1 shows one of the lights 30 for light string 20, one of the lights 32 for light string 22, one of the lights 34 for light string 24 and one of the lights 36 for light string 26. A complete picture would be to continue the cable 18 on so that the total number of lights are included in the view.

In the preferred embodiment, a receiver R is provided within a small receiver housing 38. A window 40 through which the command signals pass is provided at one end of the housing 38. The housing 38 may also include a hanging implement 42 that may be in the form of a hanging loop, a hook or a tie. The implement 42 serves to connect the receiver R to the object that receives the light display, e.g. a Christmas tree.

FIG. 1 also shows a command signal transmitter T having a housing 44, a plurality of control buttons, some of which are designated 46, and a window 48 out through which the command signals pass. In the preferred embodiment, the transmitter T and the receiver R are adapted to send and receive infrared (IR) control signals. The transmitter T can be a basic unit that is commercially available. For example, it can be a model CRS 1400A or CRS 1401A transmitter that is available from Custom Remote Systems.

Figure 9:
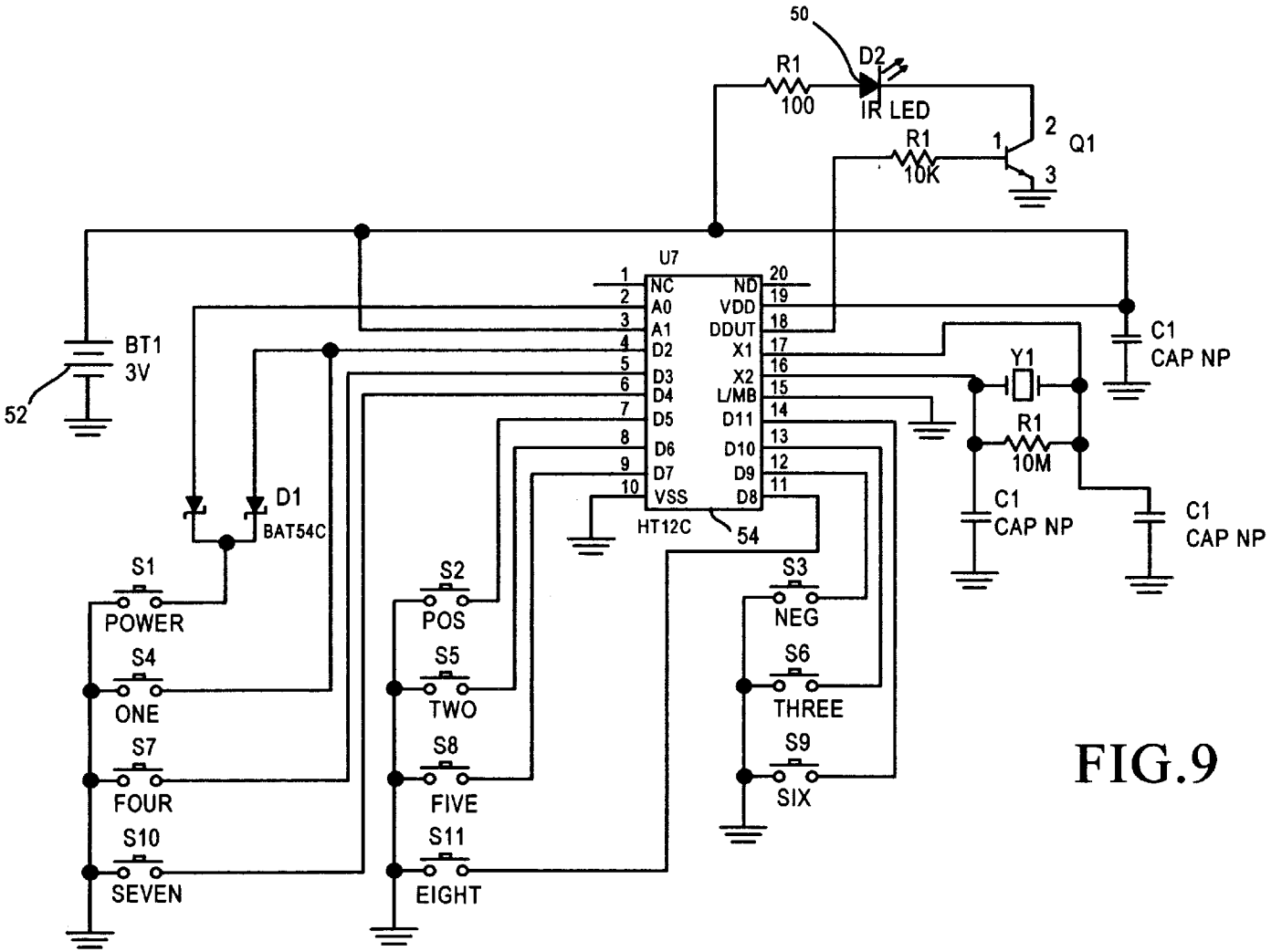
FIG. 9 is a schematic diagram of an example transmitter circuit.

FIG. 9 is a schematic diagram of a representative transmitter circuit. It includes an infrared (IR) light emitting diode (LED) 50 that is positioned within the transmitter housing 44 inwardly adjacent and facing outwardly towards the window 48. The transmitter T includes a three volt direct current (DC) battery 52 that is within the housing 44. It further includes a plurality of switches S1–S11 which are positioned under and are operated by control buttons 46. When a button 46 is depressed, the switch below it is closed, completing a circuit that includes integrated circuit 54 (FIG. 9).

Figure 2:
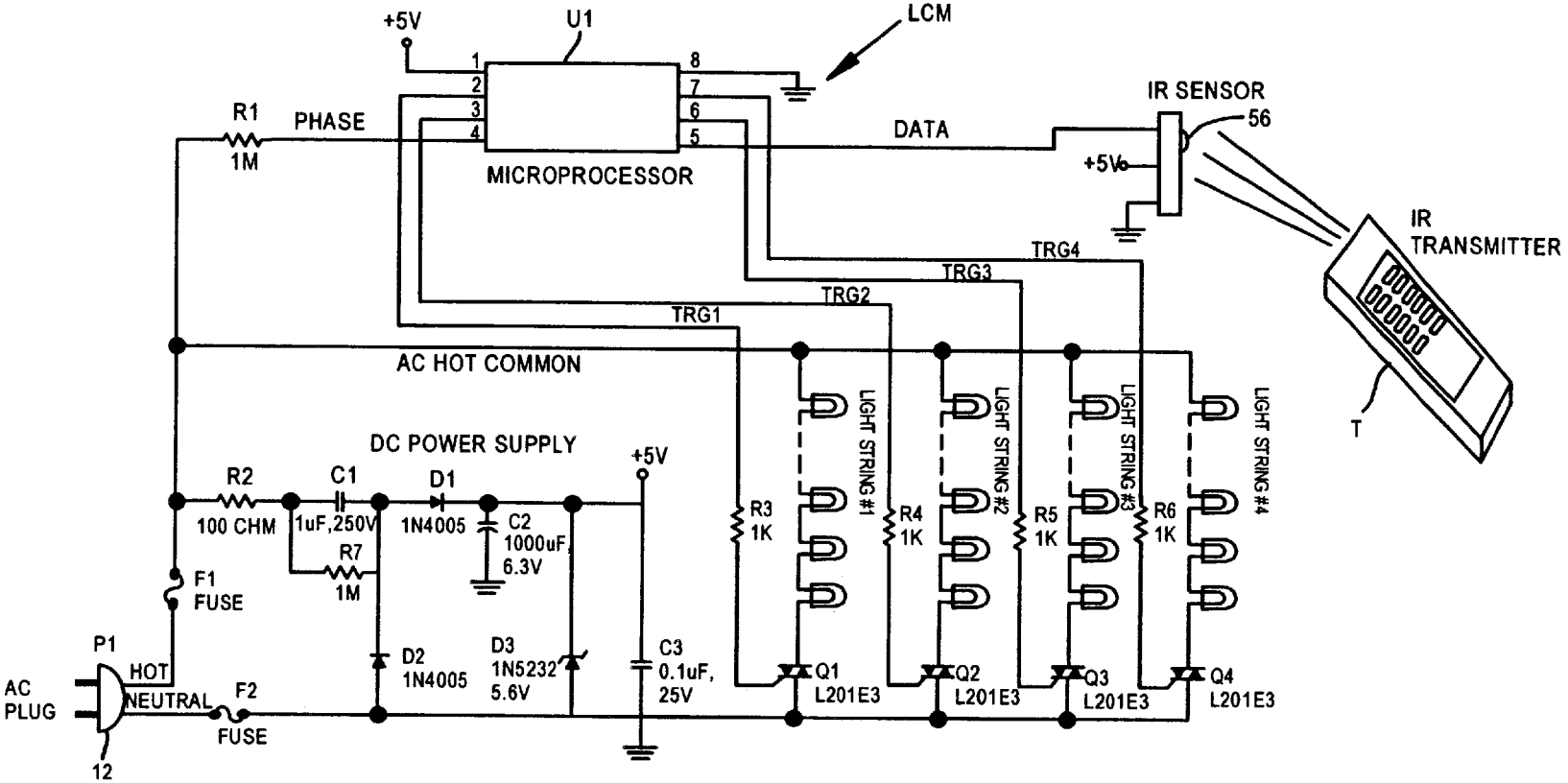
FIG. 2 is a schematic diagram of the circuit for the embodiment of FIG. 1, but showing only four lights of each light string.

Referring to FIG. 2, the LCM is powered directly from an AC line by use of the AC plug 12. The current component values allow the circuit to derive its power from a nominal 120VAC, 60 Hz power waveform. With component value changes, and microprocessor program modification, the circuit could operate from other power standards as well. The circuitry is insensitive to AC polarity reversal should the polarization of the AC plug 12 be defeated. Both the HOT and the NEUTRAL supply wires are fused for safety protection against accidental overload or fault.

The control electronics and the IR receiving sensor 56 require a DC voltage in the range of 4.5–6V. It is necessary then to convert the high input AC voltage into a low DC output voltage. Components R2, R7, C1, C2, C3, D1, D2 and D3 form the necessary AC to DC conversion.

On the positive-half of the AC waveform, current flows through F1 and R2 (FIG. 2), into the parallel combination of C1 and R7, through D1, into the parallel loads of C2, D3, and C3, and finally returns to the source through fuse F2. Diode D2 is reversed-biased during the positive-half of the AC waveform. During this time, capacitor C1 begins charging, resulting in a voltage developed across C1. At the same time, capacitor C2 and C3 begin charging, also developing voltage across them. The reactance of C1 to the power line frequency causes most of the AC line voltage to appear across C1 while capacitor C2 is charging. C2 can charge up to the zener diode D3 voltage and then D3 will clamp the voltage from rising any higher, regulating the peak voltage to power the rest of the circuit.

On the negative-half of the AC waveform, current flows through F1 and R2, into the parallel combination of C1 and R7, and through D2. Diode D1 is reversed-biased during the negative-half of the AC waveform. During this time, no current is available for charging C2 and C3. Meanwhile, the microprocessor U1 and the IR sensor R drain charge from C2 and C3, causing the voltage across them to decay. The value of C2 is selected to supply the circuit with current during the negative-half of the AC waveform and droop in voltage to an acceptable level that will still allow the circuit to operate reliably. C2 will recharge on the next cycle of AC power, refreshing the voltage at the output of the power supply. It is necessary to steer current through C1 during the negative-half of the AC waveform in order for an AC voltage to exist across C1, otherwise the circuit would cease to function after the first few cycles of power was applied.

Resistor R2 limits the amount of peak current that can charge C1 when the AC power plug is first inserted into the power receptacle at the wall. It is necessary to limit the current into C1 due to a worst case condition that can exist when C1 is discharged to zero volts and the AC plug is inserted at the peak of the AC waveform at the wall. Without R2, a large current would flow, causing F1 and/or F2 to open-circuit due to the large instantaneous current flow to charge C1. Since it is undesired to blow the fuses by powering the circuit up, it is necessary to add R2.

Resistor R7 is a UL safety requirement that prevents capacitor C1 from retaining a charge for a long period of time after the plug P1 is removed from the wall.

Capacitor C3 provides power supply decoupling at the output of the DC power supply. C3 reduces the possibility of causing power supply dropout problems when relatively large transient power supply currents are drawn for brief intervals above the average power supply current.

Integrated circuit U1 is an 8-bit microprocessor. U1 is custom-programmed to recognize the appropriate transmitted IR command and produce control signals that cause the light strings to illuminate in the desired pattern. U1 receives decoded digital data from an integrated circuit IR sensor. This sensor detects, amplifies, and demodulates digital data contained in a transmitted IR carrier frequency. The microprocessor program verifies that the digital data coming from the IR sensor follows the selected IR transmission protocol. Once the protocol is verified, the data is decoded into a valid lighting sequence command. To prevent erratic operation of the lighting display, it is important to verify both the protocol and the data. This allows the LCM to differentiate a signal coming from the lighting display remote to one coming from other appliance remotes.

Since the lighting strings are powered by AC power (via AC HOT COMMON), a Triac, alternatively known as a Bi-directional Thyristor, is used to switch on the lighting strings. Triacs are electronic switches that conduct current when a potential exists across the device and a triggering signal is applied to their control terminal known as the gate. U1 can generate triggering signals at TRIG1, TRIG2, TRIG3, and TRIG4. Each trigger signal is connected to each triac gate through a 1 Kilo-ohm resistor. These resistors limit the current drawn from U1 during a triac trigger event to about four milliamps. When a triac is turned on, it cannot be turned off unless the potential across the device is removed or made zero. In AC circuits, the power waveform always crosses through zero volts 120 times a second if the waveform is occurring at 60 Hz.

FIG. 5 is a diagram that details the zero crossing points of the AC power waveform. It can be seen that zero crossings occur every 8.3 milliseconds(ms) . If the triacs receive a trigger pulse just a few microseconds after a zero crossing in the positive half-cycle of the waveform, then essentially the entire half-cycle is available to power the light strings. The process could be repeated again on the negative half-cycle portions of the waveform. Maintaining these triac trigger points would cause the light strings to appear at full brightness.

Figure 6:
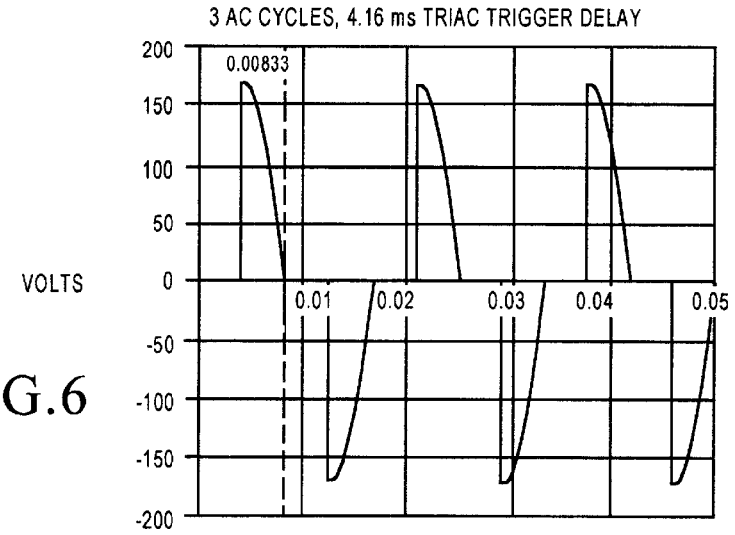
FIG. 6 is a view like FIG. 5 showing the waveform that causes the light strings to glow at about fifty percent brightness.

Full brightness is not always required by the lighting display. Delaying the trigger pulse for some period of time after a zero crossing of the AC waveform can modulate light string brightness. The delay time is the time that the light strings do not see the AC line voltage. The result is that the light strings see a chopped version of the AC waveform having a lower RMS voltage. The RMS voltage powering the light strings determines brightness. An example waveform is shown by FIG. 6 that will cause the light strings to glow at fifty percent brightness. This example was created by a trigger signal that is delayed 4.16 ms after each AC zero crossing. More or less brightness is achieved by less or more trigger delay.

To control the brightness of each light string, the microprocessor must vary the trigger timing of the triacs independently of one another. This could be implemented through individual triac trigger delay software counters, one per light string. These counters would be preset to some specific count at the AC zero crossing. A state machine implementing the specific light sequence selected by the user would determine this preset count. When these counters reached zero, the software would send a trigger signal to the appropriate light string triac turning the string on at that point in the AC waveform. When the next AC zero crossing occurred, the whole process would be reset and repeated.

The microprocessor must know when every AC zero crossing occurs in order to set a specific controlled brightness. U1 obtains a zero crossing signal at PHASE via Resistor R1. R1 is connected directly to AC HOT through the fuse F1. The input pin connected to PHASE is diode-clamped internally within U1 to its power supply rails. Since R1 is a very high resistance (1 Megohm), almost all of the AC voltage is dropped across the resistor. Working against R1, the diode clamps maintain the PHASE voltage at a diode drop above VDD at the positive AC peak voltage, and a diode drop below VSS at the negative AC peak voltage. The resulting current flowing through the diode clamps is well below the maximum specified current and so the circuit configuration is valid and performs the required function. When the microprocessor reads the signal at PHASE, it interprets a positive clamp of the signal as a digital "1" and a negative clamp as a "0". Thus, a "1" means that the AC waveform is positive in PHASE and a "0" means that the AC waveform is negative in PHASE. Any changes at PHASE from "1" to "0" or vice-versa are watched for in the microprocessor program and flagged as zero crossing events.

To electrically control lights so that they appear to move or travel, the circuit must be able to fade the lights to dark, and correspondingly, to full brightness over a time period. Fading on from dark to full brightness is accomplished by ramping the triac trigger delay from a maximum value (almost the length of an AC half-wave period, about 8.2 milliseconds) to a minimum value (approximately one hundred microseconds) over some time period (the desired fade interval). Fading from full brightness to dark requires ramping the triac trigger delay from a minimum value (approximately one hundred microseconds) to a maximum value (about 8.2 milliseconds) over the desired fade interval. The microprocessor program must control these fading intervals so that when one light string fades off, another fades on. By physically staggering the individual string's lights one after another and sequentially directing fading triac trigger sequences to the light strings, a traveling effect can be achieved. By modulating the fading rates and directing various on/off sequences of the light strings, many different lighting patterns can be achieved. The physical/electrical connection of the light strings is diagramed in FIG. 4. String 1, string 2, string 3, string 4, shown in FIG. 1 and AC HOT COMMON are all physically intertwined to form a single cable 18 (FIG. 1).

An example installation will now be described. A light display of the type that is partially shown in FIG. 1 is to be placed on a Christmas tree that is in a room within a short distance from a wall receptacle. The AC plug 12 may be positioned close to the receptacle and then the wiring 14 and the light string cable 18 may be straightened out and positioned for attachment of the light display to the tree. The AC plug 12 is maintained adjacent the receptacle while the light string cable 18 is wrapped around the tree, starting at the base of the tree and moving up in spiral fashion. A single light display may be sufficient to cover the entire tree. Or, a second light display 10 may be connected to the first light display 10 so that they can both be wrapped on to the tree. The AC plug 12 on the second display will be plugged into a receptacle that is provided at the outer end of the first lighting display 10. The conductor 39 that extends from LCM housing 16 to the receiver R may be wrapped around the beginning portion of the light string cable 18. This places it contiguous the light string cable 18. It also places the receiver R contiguous the light string cable 18. The length of wiring section 14 and conductor 19 are such that the receiver R will be positioned out on a forward portion of the tree when the light display is on the tree. This is so that the window 40 of the receiver R will be in clear sight of the wireless command signal that is emitted from the transmitter T. The operator of the transmitter T may have the transmitter T stored at some location spaced from the Christmas tree or other object on which the light display has been mounted. When it is desired to turn on the light display, or to change the dislay pattern of the lights, the operator need only pick up the transmitter T, point its window 48 towards the window 40 of the receiver R, and then operate the button 46 to turn the lights on or off or change the display pattern.

Figure 7:
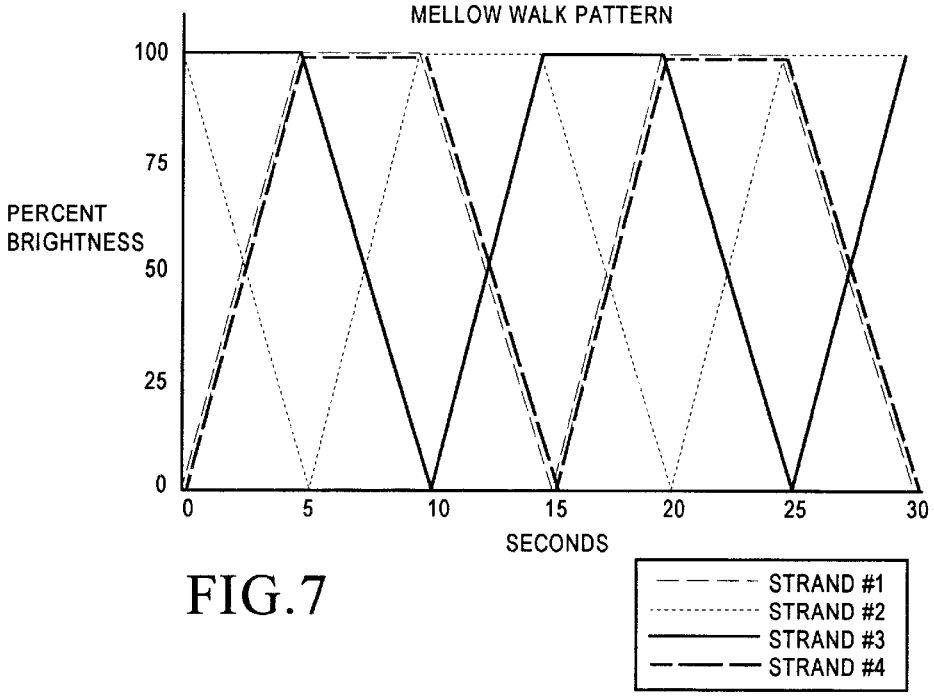
FIG. 7 is a timing diagram of a light pattern that gives the lights the appearance of traveling.
Figure 8:
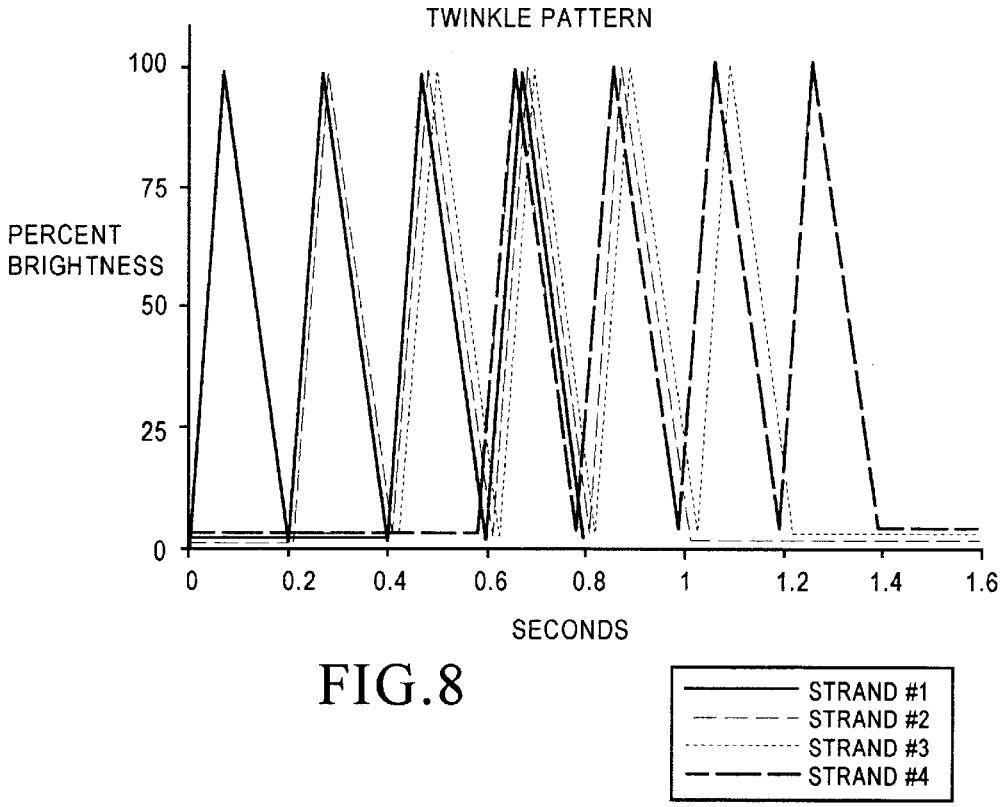
FIG. 8 is a timing diagram of a light pattern diagram that gives the lights the appearance of blinking or twinkling.

FIG. 7 shows a timing diagram for a mellow walk pattern. In this diagram the percent of brightness is plotted against time. The light strings or strands fade on and then fade off in the sequence shown by the diagram. FIG. 8 plots percent brightness versus time. In this timing pattern, the light strings or strands are faded on and off in an order that results in a twinkle pattern.

The following is a table of the components that are included in FIGS. 2 and 9:

RECEIVER PARTS FIG. 9

| Item | Qty | Part | Value | Manufacturer | Mfg. ID |
|---|---|---|---|---|---|
| 1 | 1 | C4 | 1 uF. 250 V | Panasonic | ECQ-E2105KF |
| 2 | 1 | C5 | 1500 uF, 6.3V | Panasonic | ECE V0JA152P |
| 3 | 1 | C6 | 0.1u F, 25 V | Panasonic | ECJ-2VF1E104Z |
| 4 | 1 | D1 | S1DDICT | Diodes, Inc. | SIDT |
| 5 | 1 | D2 | S1DDICT | Diodes, Inc. | SIDT |
| 6 | 1 | D3 | BZT52-C5V6DICT | Diodes, Inc. | BZTS2-C5V6D1 |
| 7 | 1 | Q1 | L201E3 | Teccor | L4X8RP |
| 8 | 1 | Q2 | L201E3 | Teccor | L4X3RP |
| 9 | 1 | Q3 | L201E3 | Teccor | L4X3RP |
| 10 | 1 | Q4 | L201E3 | Teccor | L4X3RP |
| 11 | 1 | R1 | 1M | Panasonic | ERJ-8GEYJ100V |
| 12 | 1 | R2 | 100 OHM | Panasonic | ERJ-12ZYJ101U |
| 13 | 1 | R3 | 1K | Panasonic | ERJ-8GEYJ102V |
| 14 | 1 | R4 | 1K | Panasonic | ERJ-6GEYJ102V |
| 15 | 1 | R5 | 1K | Panasonic | ERJ-6GEYJ102V |
| 16 | 1 | R6 | 1K | Panasonic | ERJ-8GEYJ102V |
| 17 | 1 | R8 | 1M | Panasonic | ERJ-8GEYJ105V |
| 18 | 1 | U1 | PIC 12C672 | Microchip | P1C12C672-04/SM |

TRANSMITTER PARTS - FIG. 2

| Item | Qty. | Part | Value | Manufacturer | Mfg. ID |
|---|---|---|---|---|---|
| 1 | 1 | C1 | 0.1 uF | Panasonic | ECU-S1H104MEA |
| 2 | 1 | C2, C3 | 100 pF | Panasonic | ECC-F1H103JC4 |
| 3 | 1 | D1–D4 | QED123 | QT Optoelectronics | QED123 |
| 4 | 4 | D2 | SD101 | Vishay/Diodes, Inc. | SD101C |
| 5 | 1 | Q1 | 2N2222 | Microsemi Corp. | 2N2222A |
| 6 | 1 | R1 | 33 OHM | Yageo | CFR-25JB 47R |
| 7 | 1 | R2 | 430 OHM | Yageo | CFR-25JB 430R |
| 8 | 1 | R3 | 10M | Yageo | CFR-25JB 10M |
| 9 | 1 | S1–S12 | SWITCH | E-Switch | TL1105DF250Q |
| 10 | 1 | U1 | HT12C | Holtek | HT12C |
| 11 | 1 | Y1 | 455 KHz | Toko | CRK455 |

The illustrated embodiments are only examples of the present invention and, therefore, are non-limitive. It is to be understood that many changes in the particular structure, materials and features of the invention may be made without departing from the spirit and scope of the invention.

It is also within the scope of this invention to use some other form of wireless control signal transmission. For example, radio frequency RF control signals can be used. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A light display, comprising:

an AC plug adapted to fit into an AC receptacle;

a lighting control module (LCM) spaced from the AC plug and including a housing;

a first length of wiring extending from the AC plug to the LCM for bringing AC power to the LCM;

a plurality of light strings extending from said LCM, each said light string including a plurality of spaced apart lights connected together by the light string;

a receiver spaced from the LCM, said receiver having a housing and being contiguous the light strings and being adapted for receiving wireless command signals from a transmitter;

a second length of wiring extending from the LCM to the receiver contiguous along the light strings;

said LCM comprising electronic circuitry in the housing including a microprocessor programmed to receive, decode and use specific wireless command signals transmitted to the receiver and in response to said command signals cause the lights to illuminate in specific defined patterns dictated by the command signals;

a remote control transmitter adapted to generate and transmit wireless command signals to the receiver for selectively establishing the specific defined patterns for the lights strings; and wherein when the AC plug is within the AC receptacle, the first length of wiring will extend from the plug to the LCM, and the plurality of light strings and the second length of wiring will extend away from the LCM, and the second length of wiring will extend from the LCM to said receiver.

2. The light display of claim 1, wherein at least one light string includes lights that are different in color from at least one other light string.

3. The light display of claim 1, wherein each light string includes lights of one color that are different in color than the lights of each other string.

4. The light display of claim 1, wherein the transmitter is programmable to send, the receiver is adapted to receive and the LCM is programed to use wireless command signals that change the degree of brightness of at least some of the lights.

5. The light display of claim 1, wherein the transmitter is programmable to send, the receiver is adapted to receive and the LCM is adapted to use wireless command signals that cause at least some of the lights to blink.

6. The light display of claim 1, wherein the transmitter is programmable to send, the receiver is adapted to receive and the LCM is programed to use wireless command signals that change the lights from brightness to dark at staggered intervals so as to produce a traveling effect.

7. The light display of claim 1, wherein the receiver includes a hanging implement usable to connect the receiver to an object that receives the light strings.

8. The light display of claim 7, wherein at least one light string includes lights that are different in color from at least one other light string.

9. The light display of claim 8, wherein each light string includes lights of one color that are different in color from the lights of each other string.

10. The light display of claim 9, wherein the transmitter is programmable to send, the receiver is adapted to receive and the LCM is programmed to use wireless command signals that cause at least one of the following defined patterns: change the degree of brightness of at least some of the lights; cause at least some of the lights to blink; change the lights from brightness to dark at staggered intervals so as to produce a traveling effect.

11. The light display of claim 9, wherein the transmitter is programmable to send, the receiver is adapted to receive and the LCM is programmed to use wireless command signals that cause at least two of the following defined patterns: change the degree of brightness of at least some of the lights; cause at least some of the lights to blink; change the lights from brightness to dark at staggered intervals so as to produce a traveling effect.

12. The light display of claim 9, wherein the transmitter is programmable to send, the receiver is adapted to receive, and the LCM is programmed to use wireless command signals to change the degree of brightness of at least some of the lights; cause at least some of the lights to blink; change the lights from brightness to dark at staggered intervals so as to produce a traveling effect.

13. The light display of claim 6, wherein each light string includes lights of one color that are different in color than the lights of each other string.

14. The light display of claim 1 wherein the light strings are wound together to form a cable and place the spaced apart lights in a pattern of a first light from a first string, followed by a first light from a second string, followed by a first light from a third string, and continuing until the first light from each string is placed, and then continuing with the second light from the first string followed by the second light from the second string, followed by the second light from the third string, and continuing the pattern until all of the second lights are in the pattern, and then continuing the pattern the same way with the third and all subsequent lights from the strings.

15. The light display of claim 14, wherein the second length of wiring is wrapped around the cable of wiring so that it helically surrounds and follows the cable.

16. The light display of claim 14, wherein the receiver includes a hanging implement usable to connect the receiver to an object that receives the light display.

17. A light display, comprising:

an AC plug adapted to fit into an AC receptacle;

a lighting control module (LCM) connected to the AC plug;

a plurality of light strings extending from said LCM, each said light string including a plurality of spaced apart lights connected together in series;

a receiver connected to the LCM and adapted for receiving wireless command signals from a transmitter;

said LCM comprising electronic circuitry including a microprocessor programmed to receive, decode and use specific wireless command signals transmitted to the receiver and in response to said command signals cause the lights to illuminate in specific defined patterns dictated by the command signals;

a remote control transmitter adapted to generate and transmit wireless command signals to the receiver for selectively establishing the specific defined patterns for the light strings;

wherein the plurality of light strings extend away from the LCM; and wherein the light strings are wound together to form a cable and place the spaced apart lights in a pattern of a first light from a first string, followed by a first light from a second string, followed by a first light from a third string, and continuing this pattern until the first light from each string is in the pattern, and then continuing with the second light from the first string followed by the second light from the second string, followed by the second light from the third string, and continuing the pattern until all of the second lights are in the pattern, and then continuing the pattern the same way with the third and all subsequent lights from the strings.

18. The light display of claim 17, wherein at least one light string includes lights that are different in color from at least one other light string.

19. The light display of claim 18, wherein each light string includes lights of one color that are different in color than the lights of each other string.

20. The light display of claim 17, wherein the transmitter is programmable to send, the receiver is adapted to receive and the LCM is programmed to use wireless command signals that change the degree of brightness of at least some of the lights.

21. The light display of claim 17, wherein the transmitter is programmable to send, the receiver is adapted to receive and the LCM is adapted to use wireless command signals that cause at least some of the lights to blink.

22. The light display of claim 17, wherein the transmitter is programmable to send, the receiver is adapted to receive and the LCM is programmed to use wireless command signals that change the lights from brightness to dark at staggered intervals so as to produce a traveling effect.

* * * * *

UNITED STATES PATENT AND TRADEMARK OFFICE

CERTIFICATE OF CORRECTION

PATENT NO. : 6,424,096 B1
DATED : July 23, 2002
INVENTOR(S) : Donovan S. Lowe, Steve Ranta and Paul Szabo It is certified that error appears in the above-identified patent and that said Letters Patent is hereby corrected as shown below:

Title page,
Item [56], References Cited, U.S. PATENT DOCUMENTS, please include U.S. PATENT No. -- 5,639,157 --, patentee -- Yeh --

Column 7,
Line 22, "dislay" should be -- display --

Column 9,
Line 4, "claim 1" should be -- claim 2 --
Line 52, "claim 6" should be -- claim 12 --

Signed and Sealed this

Nineteenth Day of November, 2002

*Attest:*

*Attesting Officer*

JAMES E. ROGAN
*Director of the United States Patent and Trademark Office*